US009367018B1

(12) United States Patent
Yanagawa et al.

(10) Patent No.: US 9,367,018 B1
(45) Date of Patent: Jun. 14, 2016

(54) IMAGE FORMING DEVICE HAVING TRIPOD TYPE CONSTANT-VELOCITY JOINT FOR COUPLING ROTARY MEMBER WITH DRIVING SOURCE

(71) Applicants: Hiroshi Yanagawa, Mie (JP); Kazuo Hirose, Mie (JP); Hiroaki Takagi, Tokyo (JP); Junichi Ichikawa, Tokyo (JP)

(72) Inventors: Hiroshi Yanagawa, Mie (JP); Kazuo Hirose, Mie (JP); Hiroaki Takagi, Tokyo (JP); Junichi Ichikawa, Tokyo (JP)

(73) Assignees: NTN CORPORATION, Osaka (JP); RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/712,000

(22) Filed: May 14, 2015

(51) Int. Cl.
*G03G 15/00* (2006.01)

(52) U.S. Cl.
CPC ..... *G03G 15/757* (2013.01)

(58) Field of Classification Search
CPC ..... G03G 15/757
See application file for complete search history.

(56) References Cited

U.S. PATENT DOCUMENTS

2005/0281586 A1* 12/2005 Ohashi ..... G03G 15/757 399/167
2006/0067737 A1* 3/2006 Yamazaki ..... G03G 15/757 399/167
2007/0201901 A1* 8/2007 Takigawa ..... F16D 3/221 399/167
2009/0054164 A1* 2/2009 Takigawa ..... F16D 3/221 464/141
2009/0196655 A1* 8/2009 Takigawa ..... G03G 21/186 399/167

FOREIGN PATENT DOCUMENTS

JP 2007-256492 10/2007

* cited by examiner

*Primary Examiner* — Sandra Brase
(74) *Attorney, Agent, or Firm* — Wenderoth, Lind & Ponack, L.L.P.

(57) ABSTRACT

An image forming device includes a tripod type constant-velocity joint through which a rotary member shaft of a rotary member is connected to the drive shaft of a motor. The constant-velocity joint includes a pair of outer rings each having three axially extending track grooves in its inner periphery, and a tripod member having three protrusions formed on each of the axial ends thereof and axially slidably received in the corresponding track grooves. The outer rings and the tripod member are formed of synthetic resin. One of the outer rings and the tripod member are inseparably coupled to the drive shaft so that the other of the outer rings is always disconnected from the tripod member when the rotary member is pulled away from the motor.

4 Claims, 5 Drawing Sheets

IMAGE FORMING DEVICE HAVING TRIPOD TYPE CONSTANT-VELOCITY JOINT FOR COUPLING ROTARY MEMBER WITH DRIVING SOURCE

BACKGROUND OF THE INVENTION

This invention relates to an image forming device, such as a copier or a laser beam printer (LBP), using a constant-velocity joint.

A known image forming device includes a photoconductor drum rotated in one direction, and an electrifier, a light exposure means, a developing unit, and an image transfer roller which are provided around the photoconductor drum.

In such an image forming device, an electrostatic latent image is first formed on the photoconductor drum by exposing the drum to image light based on image information with the light exposure means, after uniformly electrifying the entire outer periphery of the photoconductor drum by means of the electrifier. Then, a toner is supplied onto the electrostatic latent image from the developing unit to form a toner image on the photoconductor drum. The toner image thus formed is then transferred onto recording paper by the image transfer roller, with the recording paper being fed at the same speed as the peripheral speed of the photoconductor drum.

In such an image forming device, if the mounting position of an image forming unit including the photoconductor drum is not accurate enough, the rotational speed of the photoconductor drum could fluctuate while the drum rotates once. For example, due to dimensional errors of the image forming unit or parts of the main body of the device supporting the image forming unit (such as frames and slide rails), the drum shaft of the photoconductor drum may be vertically or horizontally displaced from the dive shaft of the motor. Also, even if the drum shaft and the drive shaft of the motor are initially aligned with each other, after the image forming device is repeatedly mounted to and dismounted from the main body of the device, mounting errors may accumulate gradually.

In either case, the shaft of the photoconductor drum (which is hereinafter referred to as the rotary member shaft) will become inclined relative to the drive shaft of the driving source, thus causing fluctuations in rotational speed of the photoconductor drum.

If the rotational speed of the photoconductor drum fluctuates per rotation of the drum, an electrostatic latent image formed on the photoconductor drum by exposing the drum to light with the light exposure means will expand or shrink, which in turn causes expansion or shrinkage of a picture image formed on the transfer material by transferring a toner image, thus blurring the picture image. Thus, since fluctuations in the rotational speed of the photoconductor drum makes it difficult to obtain high-quality picture images, it is necessary to rotate the photoconductor drum at a constant speed.

For this purpose, Japanese Patent Publication 2007-256492A proposes to couple the rotary member shaft of the photoconductor drum to the drive shaft of the driving source through a tripod type constant-velocity joint, thereby preventing expansion and shrinkage of a picture image formed on a transfer material due to fluctuations in rotational speed of the photoconductor drum.

The constant-velocity joint disclosed in this publication comprises an outer ring and a tripod member mounted inside of the outer ring. The outer ring has three axially extending track grooves formed in the inner periphery thereof at angular intervals of 120 degrees. The tripod member has three protrusions slidably inserted in the respective track grooves such that torque is transmitted between the outer ring and the tripod member through the protrusions. The outer ring has bulges between the respective adjacent pairs of track grooves. Each bulge is formed at the distal end portions thereof with a pair of tapered surfaces. Each of the protrusions of the tripod member has a pair of tapered surfaces on the front side thereof.

This constant-velocity joint allows the axis of the rotary member shaft and the axis of the drive shaft to be inclined relative to each other with a relatively large angle therebetween, provided the two axes intersect each other in or near the joint. However, this constant-velocity joint does not allow the above two axes to be inclined relative to each other with a relatively large angle, if the above two axes intersect each other at a position remote from the joint. Also, this constant-velocity joint does not allow too large an offset between the above two axes if the axes are parallel to each other.

For rotary members of an image forming device other than the photoconductor drum which are rotated about their axes under a driving force, such as electrifying rollers, developing rollers, stirring rollers, it is also necessary to minimize fluctuations in rotational speeds of these rotary members per rotation in order to form high-quality picture images.

It is also desired that the rotary member shafts of these rotary members be smoothly connected to the corresponding drive shafts.

SUMMARY OF THE INVENTION

An object of the present invention is to minimize fluctuations in the rotational speed of each of the various rotary members used in an image forming device and used to form a toner image to be transferred onto a transfer material by rotating about an axis under a driving force, to allow a large angle between the axis of the rotary member shaft and the axis of the drive shaft as well as a large offset between these axes, and to allow smooth connection between the rotary member shaft and the drive shaft.

In order to achieve this object, the present invention provides an image forming device comprising a rotary member configured to form a toner image which is to be transferred onto a transfer material, a driving source for rotating the rotary member about an axis of the rotary member, and a driving force transmission mechanism through which driving force from the driving source is transmitted to the rotary member, wherein the driving force transmission mechanism comprises a drive shaft extending from the driving source, a rotary member shaft extending from the rotary member, and a coupling means (coupling member) through which the drive shaft is coupled to the rotary member shaft such that rotation of the drive shaft is transmitted to the rotary member shaft through the coupling means, wherein the coupling means is configured to reduce fluctuations in rotational speed of the rotary member shaft when an axis of the drive shaft and an axis of the rotary member shaft form an angle other than 180 degrees, or when the axis of the drive shaft and the axis of the rotary member shaft are out of alignment with each other, wherein the coupling means is a tripod type constant-velocity joint comprising a first outer ring, a second outer ring, and a tripod member through which the first and second outer rings are coupled together, wherein the first outer ring has an inner periphery formed with three axially extending first track grooves arranged at angular intervals of 120 degrees, and the second outer ring has an inner periphery formed with three axially extending second track grooves arranged at angular intervals of 120 degrees, wherein the tripod member has a first axial end formed with three first protrusions and a second axial end formed with three second protrusions, wherein the first protrusions are axially slidably received in the respective first track grooves, while the second protrusions are axially slidably received in the respective second track grooves, whereby torque around an axis is transmitted between the first outer ring and the tripod member and between the second outer ring and the tripod member through the first and second protrusions, wherein the tripod member and the first and second outer rings are formed of synthetic resin, wherein the second outer ring or the tripod member is provided with an anti-separation arrangement configured to allow the first protrusions to be axially disconnected from the first outer ring more easily than the second protrusions are axially disconnected from the second outer ring, wherein the first outer ring is formed with three bulges between the respective adjacent pairs of the first track grooves, wherein each of the bulges is formed at a distal end portion thereof with a pair of tapered surfaces inclined in circumferentially opposite directions to each other, and defining a first apex between the tapered surfaces at substantially a central portion of the bulge with respect to a circumferential direction of the first outer ring, wherein each of the first protrusions is formed on a front surface thereof with a pair of tapered surfaces from substantially a widthwise central portion of the first protrusion toward two sides of the first protrusion, respectively, thereby defining a second apex at substantially the widthwise central portion of the first protrusion, and wherein at least one of the three first apexes is located at an axial position different from axial positions of the other first apexes.

Since the rotary member shaft, which is on the side of a rotary member used to form a toner image, such as a photoconductor drum or a developing roller, is coupled to the drive shaft, which is on the side of the driving source, through a tripod type constant-velocity joint, even if the axis of the rotary member shaft is not aligned with the axis of the drive shaft, in other words, even if these two axes are inclined relative to each other or offset from each other, it is possible to rotate the rotary member at a constant speed. This prevents expansion and shrinkage of a toner image formed by the rotary member, and thus expansion and shrinkage of a picture image transferred onto a transfer material. This ensures extremely high quality of the picture image obtained.

Since the tripod type constant-velocity joint comprises a pair of outer rings each having three track grooves, and a tripod member having three protrusions received in the track grooves of one of the outer rings, and additional three protrusions received in the track grooves of the other of the outer rings such that the tripod member is capable of swiveling and bending at the two ends of the tripod member, this joint allows a larger inclination angle and a larger offset between the rotary member shaft and the drive shaft.

Since the tripod member and the two outer rings are formed of synthetic resin, no lubricant such as grease is necessary, which in turn eliminates the necessity of a member for preventing leakage of lubricant, such as a boot. This makes maintenance easier. There is no possibility of a transfer material from being soiled due to leakage of lubricant. Operating noise while torque is being transmitted decreases too.

Rotary members used to form a toner image, such as a photoconductor drum and a developing roller, have to be frequently dismounted from, and then remounted to, the main body of the device, in order to replenish a toner or other expendables, for maintenance, or to replace deteriorated parts. For this purpose, the rotary member shaft and the drive shaft have to be frequently disconnected from each other (no driving force is transmitted in this state), and then reconnected together (driving force is transmitted).

By configuring the constant-velocity joint such that the tripod member is more easily disconnected from one of the outer rings at one end than from the other of the outer rings at the other end, it is possible to disconnect the rotary member shaft from the drive shaft at the same position. In other words, when the rotary member is moved away from the driving source, the protrusions at one axial end of the tripod member is spontaneously disengaged from the corresponding track grooves, so that this one axial end of the tripod member is disconnected from the corresponding outer ring. By pushing the rotary member toward the driving source, the protrusions are engaged in the track grooves, so that the one axial end of the tripod member is spontaneously connected to the corresponding outer ring.

In order to make one of the axial ends of the tripod member more easily separable from the corresponding outer ring than the other of the axial ends, the tripod member and the outer rings may be e.g. arranged such that the other axial end of the tripod member is more difficult to be axially disconnected form the other outer ring by providing the other outer ring or the tripod member with an anti-separation means.

Such an anti-separation arrangement may comprise a first axial hole formed in the second outer ring, and a second axial hole formed in the tripod member, wherein the drive shaft is inserted through the first and second axial holes such that the second outer ring and the tripod member are not separable from the drive shaft.

In order to allow smooth insertion of the protrusions at the one axial end into the corresponding track grooves when the axial one end of the tripod member is connected to the corresponding outer ring, each track groove of the outer ring may have a guide function at the inlet portion thereof. Specifically, the one outer ring is formed with three bulges between the respective adjacent pairs of the first track grooves, each of the bulges is formed at a distal end portion thereof with a pair of tapered surfaces inclined in circumferentially opposite directions to each other, and defining a first apex between the tapered surfaces at substantially a central portion of the bulge with respect to the circumferential direction of the first outer ring, and each of the protrusions at the one axial end of the tripod member is formed on the front surface thereof with a pair of tapered surfaces from substantially the widthwise central portion of the protrusion toward both sides of the protrusion, respectively, thereby defining a second apex at substantially the widthwise central portion of the first protrusion.

With this arrangement, even if the track grooves of the unfixed outer ring are not circumferentially aligned with the corresponding protrusions when the joint is assembled by inserting the tripod member into the unfixed outer ring through the open end thereof, the protrusions are brought into contact with and guided by the tapered surface at the distal ends of the bulges toward the open distal ends of the respective track groove. This eliminates the necessity to align the track grooves with protrusions beforehand, so that the tripod type constant-velocity joint can be assembled extremely easily.

At least one of the three first apexes may be located at an axial position different from the axial positions of the other first apexes. Preferably, one of the three first apexes is located forwardly of the other two first apexes. With this arrangement, the rotary member shaft can be more smoothly connected to the drive shaft.

If the apexes of the three bulges of the unfixed outer ring are at the same axial positions, when the joint is assembled, the tripod member and unfixed outer ring will be supported by each other at three points if the apexes of the bulges are at the same circumferential positions as the apexes of the corresponding three protrusions of the tripod member. This makes it impossible for the tapered surfaces to guide the apexes, and also could damage the apexes if a larger-than-expected pushing force is applied. To avoid these problems, the apexes are preferably arranged in the above-described manner.

According to the present invention, since the rotary member shaft of a rotary member used to form a toner image, such as a photoconductor drum or a developing roller, is connected to the drive shaft of a driving source through a tripod type constant-velocity joint, it is possible to rotate the rotary member at a constant speed even if the rotary member shaft and the drive shaft are inclined relative to each other of their axes or are offset from each other. This in turn prevents expansion and shrinkage of a toner image formed by the rotary member, and thus prevents expansion and shrinkage of a picture image formed by transferring the toner image onto a transfer material. The picture image thus obtained is of extremely high quality.

Since the tripod type constant-velocity joint comprises a pair of outer rings each formed with three track grooves, and a tripod member having three protrusions received in the three track grooves of one of the outer rings, and additional three protrusions received in the three track grooves of the other outer ring, it is possible to rotate the rotary member at a constant speed even if the rotary member shaft and the drive shaft are inclined with a large inclination angle, or the offset of their axes is large. It is also possible to smoothly connect the rotary member shaft to the drive shaft.

DETAILED DESCRIPTION OF THE PREFERRED EMBODIMENTS

Figure 1:
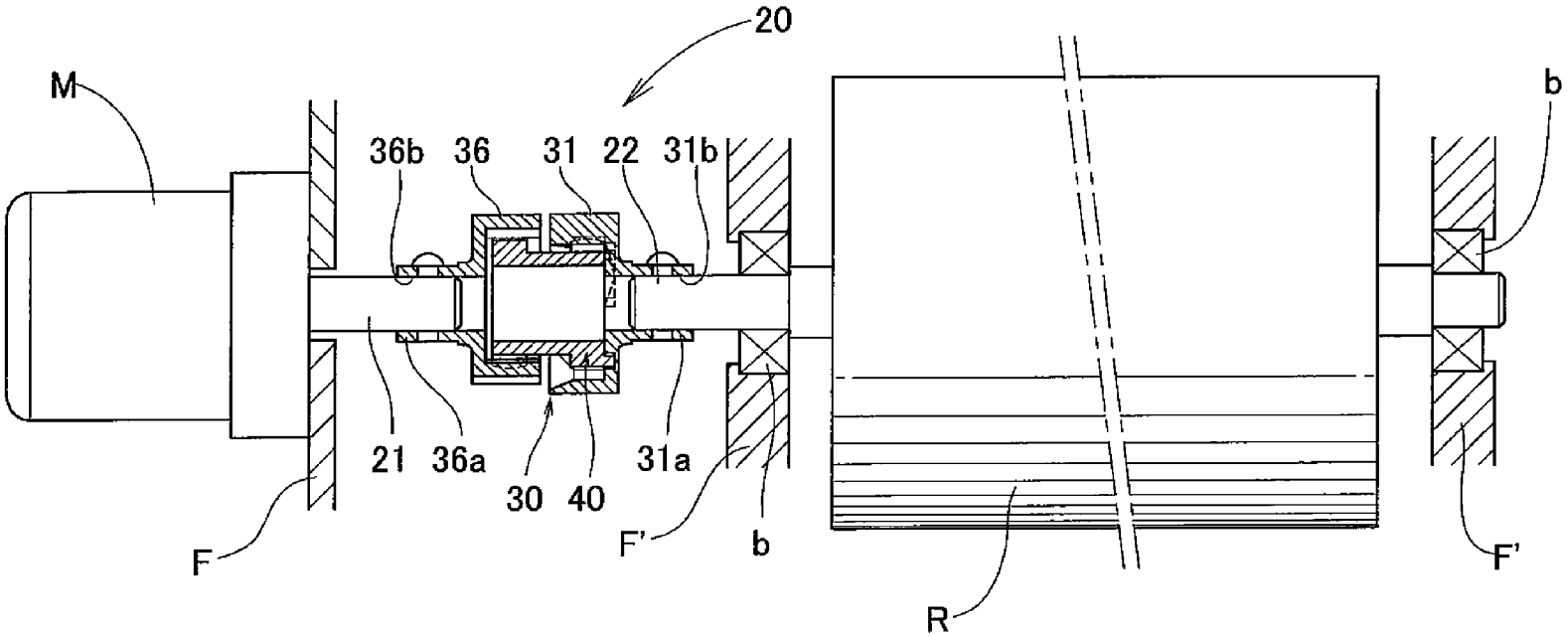
FIG. 1 is a partial enlarged view of an image forming device embodying the present invention.
Figure 2A:
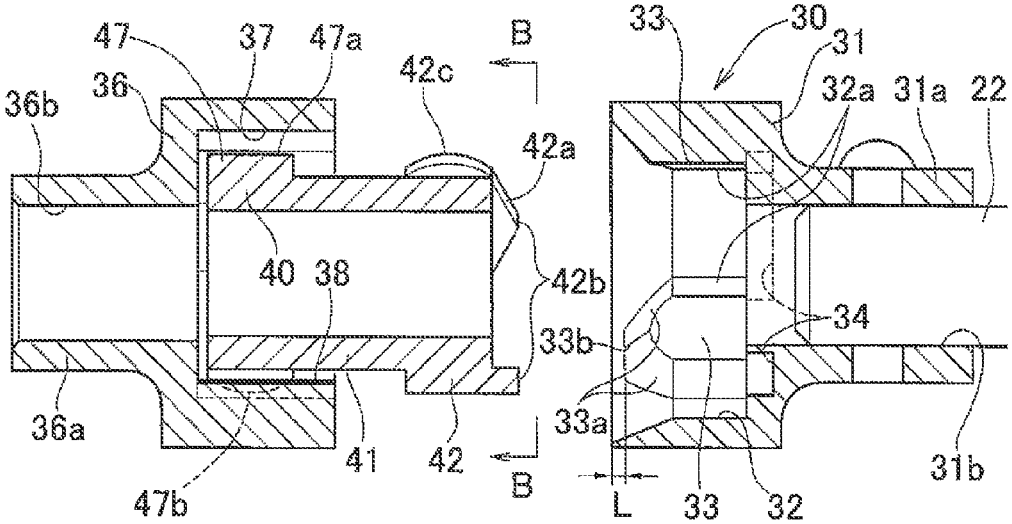
FIG. 2A is a sectional view of a pair of outer rings forming a coupling means.
Figure 2B:
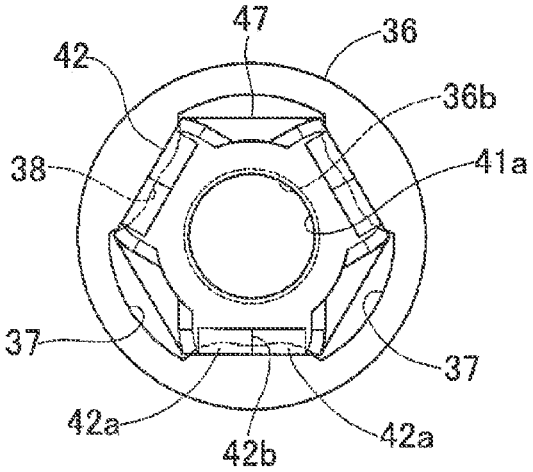
FIG. 2B is a sectional view taken along line B-B of FIG. 2A.
Figure 3:
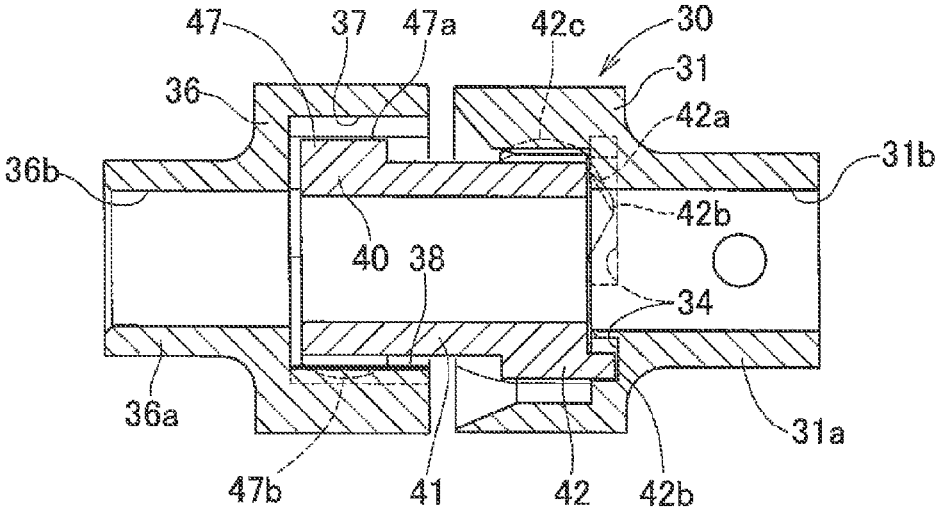
FIG. 3 is a sectional view of the coupling means.
Figure 4:
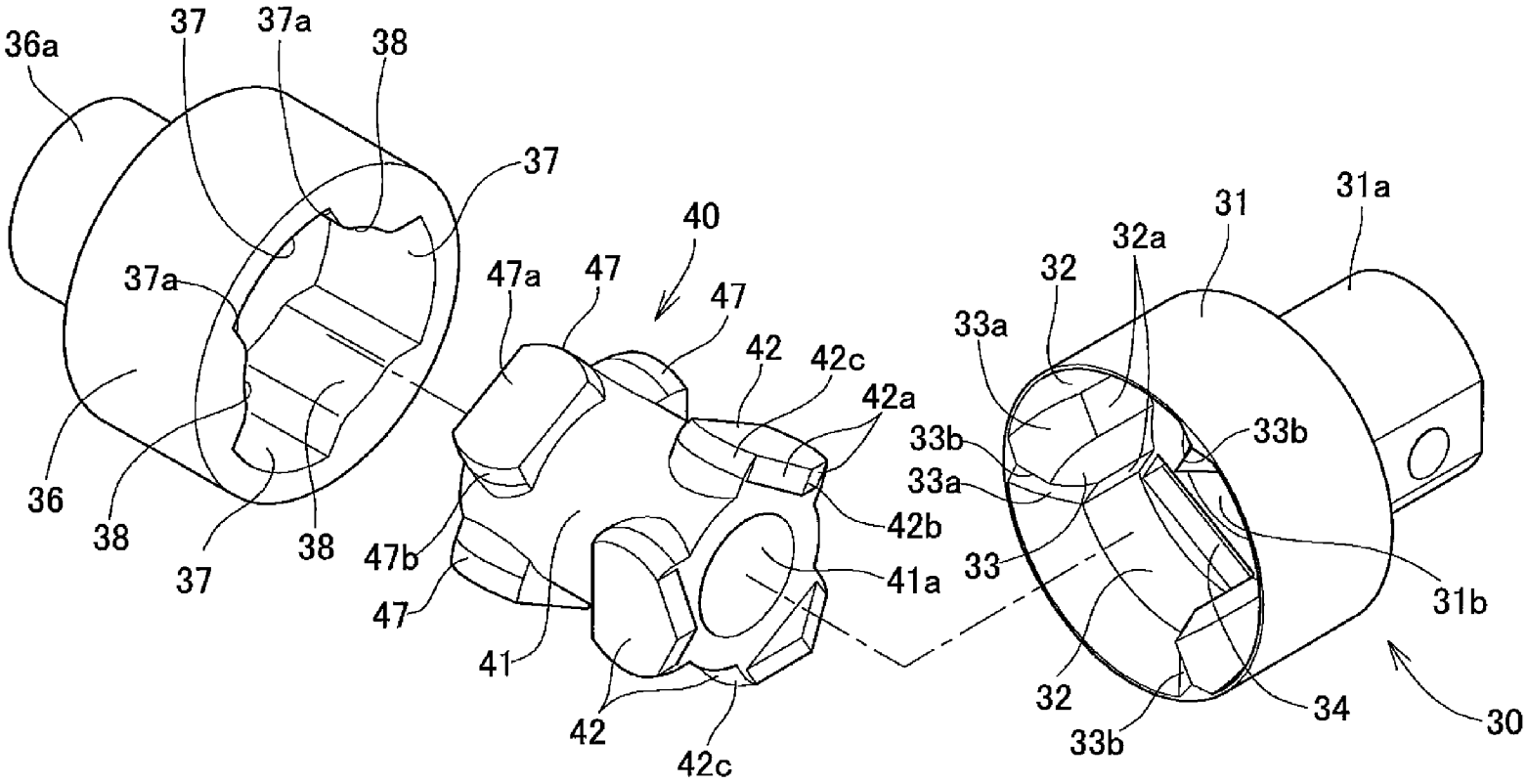
FIG. 4 is an exploded perspective view of the coupling means.

An embodiment of the present invention is now described. FIG. 1 shows a portion of an image forming unit 10 used in an image forming device.

The image forming unit 10 includes a rotary member R involved in forming toner images. The rotary member R is rotated about its center axis by a driving source M comprising a motor through a driving force transmission mechanism 20.

The driving force transmission mechanism 20 includes a coupling means (coupling member) 30 through which a drive shaft 21 extending from the driving source M is coupled to a rotary member shaft 22 extending from the rotary member R. The coupling member 30 is configured such that when the center axis of the rotary member shaft 22 is not aligned with the center axis of the driving shaft 21, that is, when the angle therebetween is not 180 degrees, or while the center axes are offset from each other, the rotation of the drive shaft 21 can be transmitted to the rotary member shaft 22 through the coupling member 30 while minimizing fluctuations in the rotational speed of the rotary member shaft 22. FIGS. 2A, 2B, 3 and 4 show the detailed structure of the coupling member 30.

The driving force transmission mechanism 20 can be used for both a rotary member R used in a mono-color image forming device and a rotary member R used in a full-color image forming device.

Figure 6:
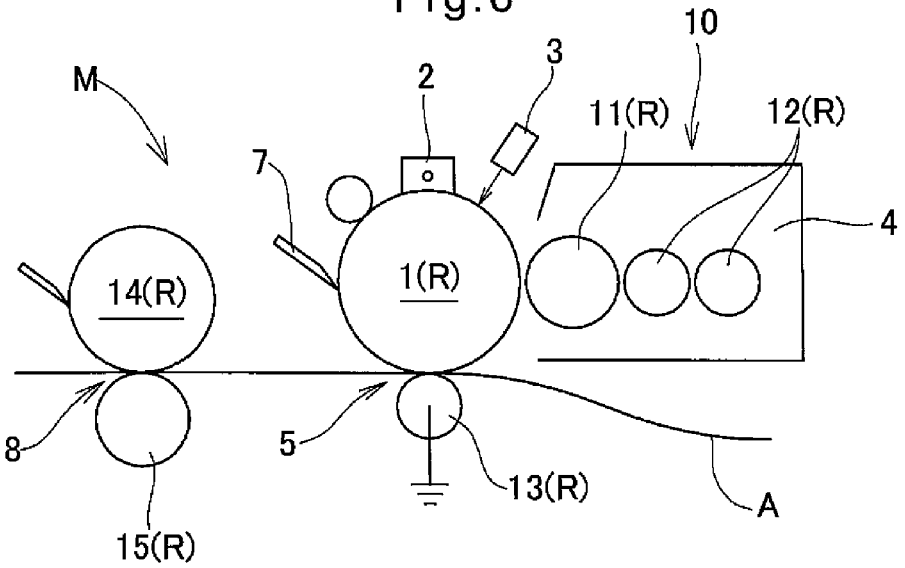
FIG. 6 is a schematic view of a mono-color image forming device.

FIG. 6 shows a mono-color image forming device. This image forming device includes an image forming unit 10 comprising a photoconductor drum 1, an electrifier 2, a light exposure means 3, a developing subunit 4, and an image transfer roller 13, and configured to create a toner image and transfer the thus created toner image onto recording paper A as a transfer material, as a picture image.

In particular, an electrostatic latent image is first formed on the photoconductor drum 1 by exposing the drum 1 to image light based on image information with the light exposure means 3, after uniformly electrifying the entire outer periphery of the photoconductor drum 1 by means of the electrifier 2. Then a toner is supplied onto the electrostatic latent image from the developing subunit 4 to form a toner image on the photoconductor drum 1. The toner image thus formed is then transferred onto the recording paper A by the image transfer roller 13, with the recording paper A being fed at the same speed as the peripheral speed of the photoconductor drum 1. The thus transferred image is fixed to the recording paper A by applying heat and pressure to the recording paper A in an image fixing subunit 8. Toner remaining on the periphery of the photoconductor drum 1 after transferring the image is removed by a cleaning unit 7.

Rotary members R are mounted in the developing subunit 4 so as to be rotated about their respective axes under the driving force from driving sources M. Such rotary members R include a developing roller 11 and a stirring roller 12. The photoconductor drum 1 and the image transfer roller 13, which form an image transfer subunit 5, are also rotary members rotated about their respective axes under the driving force from driving sources M. The image fixing subunit 8 includes an image fixing roller 14 and a pressure roller 15, which are also rotary members R rotated about their respective axes under the driving force from driving source. These rotary members R cooperate to form a toner image to be transferred onto the transfer material.

Figure 5:
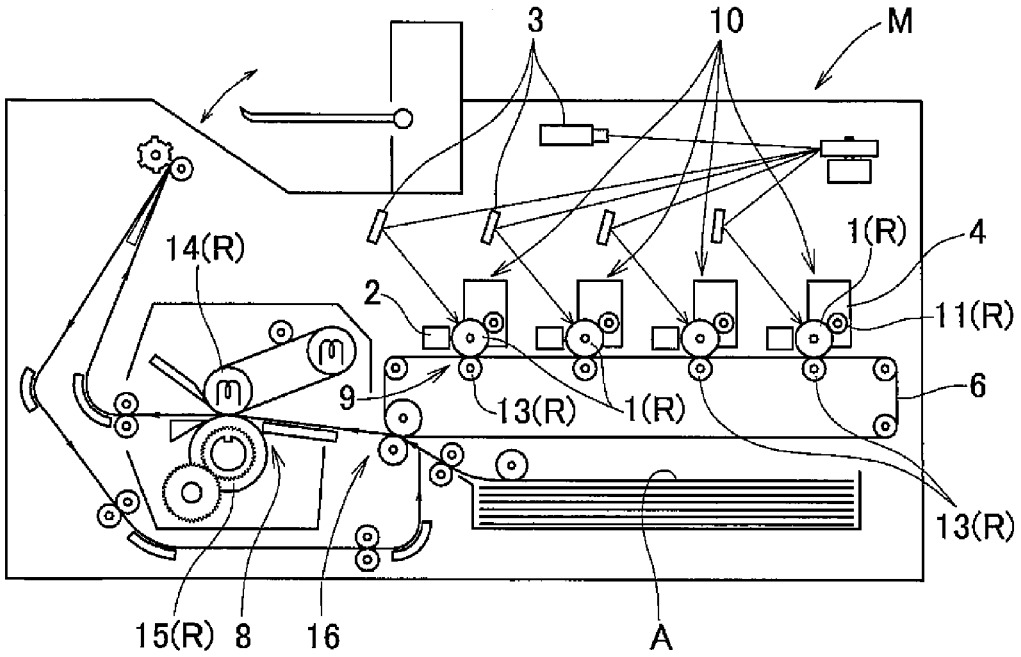
FIG. 5 is a schematic view of a full-color image forming device.

FIG. 5 shows a full-color image forming device. This image forming device includes four of the image forming units 10 which are arranged in tandem in the feed direction of an intermediate transfer material 6. The respective image forming units 10 form yellow, magenta, cyan and black toner images, and these toner images are transferred onto the intermediate transfer material 6 in the respective image transfer subunits 9, and then transferred onto recording paper A as a transfer material in a secondary image transfer unit 16 to form a color image on the paper A.

In the following embodiment, the driving force transmission mechanism 20 is used to couple the developing roller 11 as a rotary member R in either of the above image forming devices to a driving source M. However, the driving force transmission mechanism 20 according to the present invention can be used for any of the above-described other rotary members R.

As shown in FIG. 1, the rotary member R (developing roller 11) has rotary member shafts 22 at both ends thereof which are respectively supported by a pair of frames F' through bearings b so as to be rotatable about the axis of the rotary member R. The driving source M for driving the rotary member R is mounted to a frame F on the side of the body of the image forming device so as to axially face the rotary member R. The frames F' are movable in the axial direction of the rotary member shafts 22 along the rotary member shafts 22, toward and away from the frame F, such that the image forming unit 10 including the rotary shaft R can be mounted to and detached from the body of the image forming device.

The coupling member 30 is a tripod type constant-velocity joint through which the drive shaft 21 of the driving source M is coupled to one of the rotary member shafts 22 of the rotary member R. The coupling member 30 includes a pair of outer rings 31 and 36, and a tripod member 40 through which the outer rings 31 and 36 are coupled together. The tripod member 40 and the outer rings 31 and 36 are all formed of synthetic resin, which is preferably an injection-moldable synthetic resin. Such an injection-moldable synthetic resin may be a thermoplastic resin or a thermosetting resin.

Each of the outer rings 31 and 36 is a cup-shaped member having an open end and including a shaft portion 31*a* or 36*a* at the closed end thereof. Axial holes 31*b* and 36*b* are formed in the outer rings 31 and 36, respectively, as shown, for example, in FIGS. 1, 2A, 3, 4, and 7. Each of the outer rings 31 and 36 has on its inner periphery three track grooves 32 or 37 arranged at angular intervals of 120 degrees. Each of the track grooves 32 and 37 have a circumferentially opposed pair of side surfaces 32*a* or 37*a* which are flat surfaces extending parallel to each other.

The tripod member 40 includes a shaft-shaped main body 41 formed with three protrusions 42 at one axial end of the main body 41, and three protrusions 47 at the other axial end of the main body 41. The three protrusions 42 are received in the respective track grooves 32 of the outer ring 31, while the three protrusions 47 are received in the respective track grooves 37 of the outer ring 36. The protrusions 42 are configured such that their distal ends are received in recesses 34 formed in the deeper ends of the respective track grooves 32 of the outer ring 31.

The protrusions 42 and 47 are axially slidable in the respective track grooves 32 and 37. Each of the protrusions 42 and 47 has two side surfaces 42*c* or 47*b* facing the respective side surfaces 32*a* or 37*a* of the corresponding track groove 32 or 37. The side surfaces 42*c* and 47*b* are cylindrical surfaces curved along the axial direction of the tripod member 40. In the embodiment, the opposed cylindrical side surfaces of each protrusion have a center axis extending in the radial direction of the tripod member and coinciding with the axis of the protrusion 42, 47 in the protruding direction of the protrusion. However, instead of such cylindrical side surfaces, the protrusions may have spherical side surfaces. Radially outwardly facing surfaces of protrusions 47 are referred to as surfaces 47*a*.

The protrusions 42 and 47 are configured such that when turning torque is applied to one of the drive shaft 21 and the rotary member shaft 22, the side surfaces 42*c* and 47*b* engage the respective side surfaces 32*a* and 37*a* of the track grooves 32 and 37, whereby turning torque around the axis is transmitted between the outer rings 31 and 36 and the tripod member 40.

The coupling member 30 is configured such that when the side surfaces 32*a* and 37*a* of the track grooves 32 and 37 are brought into sliding contact with the corresponding side surfaces 42*c* and 47*b* of the protrusions 42 and 47, and as a result, the axes of the rotary member shaft and the drive shaft are not aligned with each other or the two shafts are inclined relative to each other, the outer rings 31 and 36 and the tripod member 40 can be smoothly inclined or swiveled relative to each other.

The outer ring 31, which is not fixed, has bulges 33 formed between the respective adjacent track grooves 32. Each bulge 33 has a pair of tapered surfaces 33*a* formed at its distal end (end facing the opening of the outer ring 31) so as to be inclined in circumferentially opposite directions to each other, thereby defining an apex 33*b* at substantially the central portion of the bulge 33 with respect to its circumferential width. The apex 33*b* is in the form of a straight ridgeline extending in the radial direction of the outer ring 31.

The outer ring 36, which is fixed, also has bulges 38 formed between the respective adjacent track grooves 37. However, since the outer ring 36 is not frequently disconnected from the tripod member, it is not necessary to provide the bulges 38 with the tapered surfaces and apexes.

The three protrusions 42, which are formed at the end of the tripod member 40 connected to the unfixed outer ring 31, are each formed on its front surface with a pair of tapered surfaces 42*a* inclined from the widthwise center of the protrusion 42 toward both sides thereof, thereby defining an apex 42*b* at substantially the central portion of the protrusion 42 with respect to its circumferential width. The apex 42*b* is in the form of a straight ridgeline extending in the radial direction of the tripod member 40.

In either of the above-described image forming devices, it is now supposed that the body of the image forming unit 10 or each of the image forming units 10 is not supported at a correct position. In such a state, the axis of the rotary member shaft 22 of the rotary member R and the axis of the drive shaft 21 of the driving source M are displaced from each other in the vertical direction and/or horizontal direction, and thus are not aligned with other, and/or inclined relative to each other.

When torque is transmitted in this state, at the portions of the tripod member connected to the fixed and unfixed outer rings, the protrusions 42 and 47 slide in the respective track grooves 32 and 37 in the axial direction of the outer rings 31 and 36. In this state, since the side surfaces 42*c* and 47*b* of the protrusions 42 and 47 are in line contact (or in point contact, if the side surfaces 42*c* and 47*b* are spherical surfaces) with the side surfaces 32*a* and 37*a* of the track grooves 32 and 37, the resistance therebetween is small, so that the protrusions 42 and 47 can smoothly slide along the track grooves 32 and 37.

Since the tripod member 40 can be inclined and swiveled relative to the outer rings at two locations, namely at the wo end portions thereof, the coupling member enable the rotary member R to be rotated at a constant speed, i.e. without fluctuation in rotational speed, even if the rotary member shaft 22 and the drive shaft 21 are out of alignment with each other, and/or inclined relative to each other, to a considerable degree. This in turn allows the developing roller 11 to be rotated at a constant speed when forming a toner image on the photoconductor drum 1 after forming an electrostatic latent image thereof, thereby preventing expansion and shrinkage of toner images as well as final picture images.

When assembling together the outer ring 31 and the tripod member 40, each of the apexes 42*b* of the protrusions 42, which are arranged at angular intervals of 120 degrees around the axis of the tripod member, are brought into contact with one of the tapered surfaces 33*a* on both sides of the apex 42*b* of the corresponding one of the bulges 33, which are also arranged at angular intervals of 120 degrees so that the apexes 42*b* are guided along the tapered surfaces 33*a* into the respective track grooves 32.

If, however, when the outer ring 31 and the tripod member 40 are assembled together, the apexes 33*b* of the bulges 33 are angularly aligned with the respective apexes 42*b* of the protrusions 42, the outer ring 31 is supported by the tripod member 40 at three points, so that not only can the apexes 42*b* not be guided along the tapered surfaces 33*a*, but also the apexes 33*b* and 42*b*, which are in abutment with each other, could be damaged if a larger-than-expected pushing force is applied. In order to prevent such three-point support, the coupling member 30 may be configured as follows.

In particular, at least one of the apexes 33*b* of the three bulges 33 of the outer ring 31 may be positioned so as to be displaced in the axial direction from the other two of the apexes 33*b* of the bulges 33. With this arrangement, it is possible to prevent three-point support. There are the following three specific arrangements for preventing three-point support: arrangement in which two of the three apexes 33*b* are at the same axial position, and the remaining one of the apexes 33*b* is located axially forwardly (on the side of the open end of the outer ring 31) of the first two of the three apexes 33*b*; arrangement in which two of the three apexes 33*b* are at the same axial position, and the remaining one of the apexes 33*b* is located rearwardly (on the side of the closed end of the outer ring 31) of the first two of the apexes 33*b*; and arrangement in which each of the three apexes 33*b* is located at an axial position different from the axial positions of the other two of the apexes 33*b*. The apexes 42*b* of the three protrusions 42 of the tripod member 40 are arranged such that not all three of the apexes 42*b* simultaneously abut the respective apexes 33*b* of the bulges 33. For this purpose, the apexes 42*b* of the protrusions 42 may be located at the same axial position.

Figure 7:
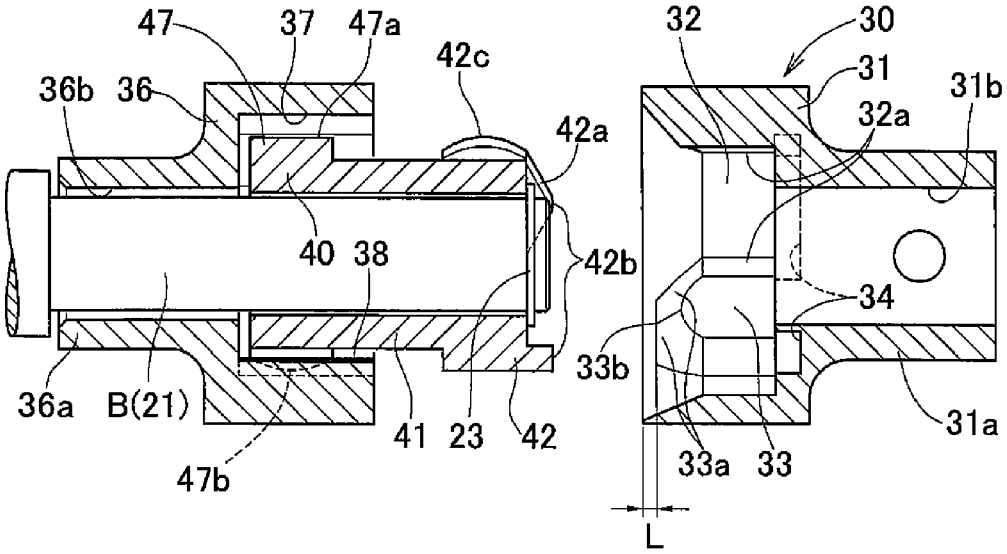
FIG. 7 is a sectional view of the coupling means, as inseparably connected to a shaft.

FIGS. 1 to 6, as well as FIG. 7, show the arrangement in which only one of the apexes 33*b* of the bulges 33 is located forwardly of the other two apexes 33*b* of the bulges 33 by a distance L, with the other two apexes 33 at the same axial position. The apexes 42*b* of the three protrusions 42 of the tripod member 40 are all located at the same axial position. With this arrangement, it is possible to avoid three-point support.

In the embodiment of FIG. 7, as means for allowing one of the two axial ends of the tripod member 40 to be more easily separable from the corresponding outer ring than the other of the two axial ends, the outer ring 36 or the tripod member 40 is provided with an anti-separation means which makes the three protrusions 47 at the other end of the tripod member 40 more difficult to be axially disconnected from the corresponding outer ring 36. The anti-separation means comprises the axial hole 36*b* formed in the outer ring 36, an axial hole 41*a* formed in the tripod member 40, a shaft B inserted through the axial holes 36*b* and 41*a*, and a snap ring 23 preventing separation of the outer ring 36 and the tripod member 40 from the shaft B. In FIG. 7, the snap ring 23 is a C-shaped member, i.e. a substantially annular member having opposed circumferential ends. The C-shaped snap ring 23 is fixedly fitted in a circumferential groove formed in the outer periphery of the shaft B.

The shaft B may be the drive shaft 21, or a shaft member which is a separate member from the drive shaft 21 and connected to the drive shaft 21 so as to be rotated about an axis together with the drive shaft 21.

In the assembled state, the tripod member 40 and the outer ring 36 are inseparably connected together so as to be capable of bending and swiveling. Thus, when the outer ring 31 and the outer ring 36 are pulled axially away from each other, the tripod member 40 is separated from the outer ring 31, while not separated from the outer ring 36.

In either of the above embodiments, the coupling member 30 comprising a tripod type constant-velocity joint is used to couple the rotary member shaft 22 of the developing roller 11 to the drive shaft 21 of the driving source M to allow the developing roller 11 to be rotated at a constant speed. However, the coupling member 30 may be used to couple the drive shaft 21 of the driving source M to any other rotary member R which is to be rotated by the driving source M and which has to be dismounted from the body of the image forming device for e.g. maintenance.

For example, the coupling member 30 comprising the tripod type constant-velocity joint shown in either of the above embodiments may be used to couple the rotary member shaft of the photoconductor drum 1 as a rotary member R to the drive shaft of the driving source M to allow the photoconductor drum 1 to be rotated at a constant speed.

By rotating the photoconductor drum 1 at a constant speed, it is possible to prevent expansion and shrinkage of an electrostatic latent image formed on the photoconductor drum 1 by the light exposure means 3, thereby preventing expansion and shrinkage of a picture image formed by transferring a toner image on the photoconductor drum 1 by the image transfer subunit 5. This ensures formation of high-quality picture images at all times. Since the photoconductor drum 1 can be rotated at a constant speed, it is possible to provide the light exposure means 3 and the image transfer subunit 5 at any desired angular positions around the photoconductor drum 1. This leads to an increased freedom of design of the device.

The above-mentioned "any other rotary member R" may be the stirring roller 12 or a toner feed roller used in the developing subunit 4, the image transfer roller 13 or any other roller used in the image transfer subunit 9 or in the secondary image transfer unit 16, or the image fixing roller 14, the pressure roller 15 or any other roller in the image fixing unit 8. The image forming unit or each of the image forming unit may include a plurality of the above-described rotary members R which are rotatably supported by e.g. a casing or a frame.

What is claimed is:

1. An image forming device comprising a rotary member configured to form a toner image which is to be transferred onto a transfer material, a driving source for rotating the rotary member about an axis of the rotary member, and a driving force transmission mechanism through which driving force from the driving source is transmitted to the rotary member, wherein the driving force transmission mechanism comprises a drive shaft extending from the driving source, a rotary member shaft extending from the rotary member, and a coupling member through which the drive shaft is coupled to the rotary member shaft such that rotation of the drive shaft is transmitted to the rotary member shaft through the coupling member, wherein the coupling member is configured to reduce fluctuations in rotational speed of the rotary member shaft when an axis of the drive shaft and an axis of the rotary member shaft form an angle other than 180 degrees, or when the axis of the drive shaft and the axis of the rotary member shaft are out of alignment with each other, wherein the coupling member is a tripod type constant-velocity joint comprising a first outer ring, a second outer ring, and a tripod member through which the first and second outer rings are coupled together, wherein the first outer ring has an inner periphery formed with three axially extending first track grooves arranged at angular intervals of 120 degrees, and the second outer ring has an inner periphery formed with three axially extending second track grooves arranged at angular intervals of 120 degrees, wherein the tripod member has a first axial end formed with three first protrusions and a second axial end formed with three second protrusions, wherein the first protrusions are axially slidably received in the respective first track grooves, while the second protrusions are axially slidably received in the respective second track grooves, whereby torque around an axis is transmitted between the first outer ring and the tripod member and between the second outer ring and the tripod member through the first and second protrusions, wherein the tripod member and the first and second outer rings are formed of synthetic resin, wherein the second outer ring or the tripod member is provided with an anti-separation arrangement configured to allow the first protrusions to be axially disconnected from the first outer ring more easily than the second protrusions are axially disconnected from the second outer ring, wherein the first outer ring is formed with three bulges between the respective adjacent pairs of the first track grooves, wherein each of the bulges is formed at a distal end portion thereof with a pair of tapered surfaces inclined in circumferentially opposite directions to each other, and defining a first apex between the tapered surfaces at substantially a central portion of the bulge with respect to a circumferential direction of the first outer ring, wherein each of the first protrusions is formed on a front surface thereof with a pair of tapered surfaces from substantially a widthwise central portion of the first protrusion toward two sides of the first protrusion, respectively, thereby defining a second apex at substantially the widthwise central portion of the first protrusion, and wherein at least one of the three first apexes is located at an axial position different from axial positions of the other first apexes.

2. The image forming device of claim 1, wherein one of the three first apexes is located forwardly of the other two first apexes.

3. The image forming device of claim 2, wherein the anti-separation arrangement comprises a first axial hole formed in the second outer ring, and a second axial hole formed in the tripod member, wherein the drive shaft is inserted through the first and second axial holes such that the second outer ring and the tripod member are not separable from the drive shaft.

4. The image forming device of claim 1, wherein the anti-separation arrangement comprises a first axial hole formed in the second outer ring, and a second axial hole formed in the tripod member, wherein the drive shaft is inserted through the first and second axial holes such that the second outer ring and the tripod member are not separable from the drive shaft.

* * * * *